US011448242B2

(12) United States Patent
Orth et al.

(10) Patent No.: US 11,448,242 B2
(45) Date of Patent: Sep. 20, 2022

(54) HYDRAULIC SYSTEM FOR USE UNDER WATER WITH A HYDRAULIC ACTUATING DRIVE

(71) Applicant: Robert Bosch GmbH, Stuttgart (DE)

(72) Inventors: Alexandre Orth, Hettstadt (DE); Gottfried Hendrix, Gemuenden (DE); Simone Karl, Rechtenbach (DE); Oliver Gerhard, Zellingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/283,223

(22) PCT Filed: Oct. 2, 2019

(86) PCT No.: PCT/EP2019/076687
§ 371 (c)(1),
(2) Date: Apr. 6, 2021

(87) PCT Pub. No.: WO2020/074338
PCT Pub. Date: Apr. 16, 2020

(65) Prior Publication Data

US 2021/0381531 A1 Dec. 9, 2021

(30) Foreign Application Priority Data

Oct. 8, 2018 (DE) ..... 10 2018 217 150.5

(51) Int. Cl.
*F15B 15/14* (2006.01)
*F15B 20/00* (2006.01)

(52) U.S. Cl.
CPC ..... *F15B 15/1404* (2013.01); *F15B 20/004* (2013.01); *F15B 2211/8757* (2013.01)

(58) Field of Classification Search
CPC ..... F15B 2211/8757; F15B 15/1404; F15B 20/004; E21B 33/0355
See application file for complete search history.

(56) References Cited

U.S. PATENT DOCUMENTS 1,993,612 A * 3/1935 Lum ..... F16D 49/16 188/170
2,942,581 A 6/1960 Gaffney
(Continued)

FOREIGN PATENT DOCUMENTS

DE 10 2014 211 806 A1 12/2015
DE 10 2015 213 695 A1 2/2016
(Continued)

OTHER PUBLICATIONS

International Search Report corresponding to PCT Application No. PCT/EP2019/076687, dated Jan. 2, 2020 (German and English language document) (5 pages).

*Primary Examiner* — Michael Leslie
(74) *Attorney, Agent, or Firm* — Maginot, Moore & Beck LLP

(57) ABSTRACT

A hydraulic system, for use under water with a hydraulic actuating drive, includes a hydraulic cylinder and at least one hydraulic machine. At least one rotary drive device and the hydraulic machine are coupled mechanically for a common rotating movement, and the hydraulic machine adjusts at least the hydraulic cylinder. The hydraulic cylinder has at least three cylinder chambers, and the hydraulic system includes a first hydraulic circuit and a second hydraulic circuit. The hydraulic system for use under water is set up, in particular, with a redundant hydraulic actuating drive for manual (mechanical) actuation.

13 Claims, 9 Drawing Sheets

(56) References Cited

U.S. PATENT DOCUMENTS

| | | | | |
|---|---|---|---|---|
| 3,572,032 | A | 3/1971 | Terry | |
| 3,933,338 | A * | 1/1976 | Herd | F16K 31/1225 251/63.6 |
| 4,500,066 | A | 2/1985 | Trassl | |
| 8,020,379 | B2 * | 9/2011 | Kakino | F15B 20/00 60/405 |
| 9,670,941 | B2 * | 6/2017 | Dalton | F15B 18/00 |
| 9,988,129 | B2 | 6/2018 | Jamieson et al. | |
| 10,428,841 | B2 * | 10/2019 | Knoell | F15B 21/006 |
| 2007/0209724 | A1 * | 9/2007 | Williams | E21B 33/0355 137/625.65 |
| 2014/0131049 | A1 | 5/2014 | Bourgeau | |
| 2015/0096435 | A1 | 4/2015 | Dalton et al. | |
| 2015/0104328 | A1 | 4/2015 | Babbitt et al. | |
| 2017/0350426 | A1 * | 12/2017 | Bohn | F15B 15/1409 |
| 2019/0085651 | A1 | 3/2019 | Phielipeit-Spiess et al. | |
| 2021/0190099 | A1 | 6/2021 | Orth et al. | |

FOREIGN PATENT DOCUMENTS

| | | | |
|---|---|---|---|
| EP | 2 101 061 | A1 | 9/2009 |
| JP | H07-223589 | A | 8/1995 |
| WO | 2004/065068 | A1 | 8/2004 |

* cited by examiner

HYDRAULIC SYSTEM FOR USE UNDER WATER WITH A HYDRAULIC ACTUATING DRIVE

This application is a 35 U.S.C. § 371 National Stage Application of PCT/EP2019/076687, filed on Oct. 2, 2019, which claims the benefit of priority to Serial No. DE 10 2018 217 150.5, filed on Oct. 8, 2018 in Germany, the disclosures of which are incorporated herein by reference in their entirety.

The disclosure relates to a hydraulic system for use under water, in particular at great water depths, with a hydraulic actuating drive. The hydraulic actuating drive serves, in particular, for actuating underwater fittings. The system preferably comprises a container which an interior which is provided for forming a volume which is closed off with respect to the surroundings and is provided for receiving a hydraulic pressure fluid. Furthermore, the system comprises a hydraulic cylinder and at least one hydraulic machine which are arranged in the interior of the container. The hydraulic system for use under water is set up, in particular, with a redundant hydraulic actuating drive for manual (mechanical) actuation.

BACKGROUND

Hydraulic systems of this type are used, above all, in order, under water at water depths of up to several thousand meters, to move an element in conjunction with the extraction of mineral oil and natural gas, with mining, scientific investigations, infrastructure projects or renewable energy projects. Thus, process valves are found, for example, in the case of mineral oil or natural gas extraction systems at sea at great depths, by way of which process valves the volumetric flow of the medium to be conveyed can be regulated or shut off.

An electrohydraulic system can be configured with an electrohydraulic actuating drive which comprises a container, in the interior of which a hydrostatic machine which can be operated at least as a pump and an electric machine which is coupled mechanically to the hydrostatic machine are arranged. Here, the main drive of the actuating drive takes place via an electric motor which drives the pump and thus adjusts the hydraulic cylinder with a rectilinear movement. The electric motor consumes a considerable amount of electric energy which has to be supplied, for example, via undersea cables. The actuating drive adjusts, for example, large production fittings of oil or gas boreholes, which large production fittings regulate the conveying rate. In order that a process valve can also be actuated manually by way of a robot, such as, for example, by way of a Remote Operated Vehicle (ROV) or an Autonomous Underwater Vehicle (AUV), for example in the case of an emergency, there is a manual interface on the container, proceeding from which manual interface a rod is coupled to a piston in the cylinder. In the interface, the rod can have a movement thread and can interact with a threaded nut which is provided with an internal thread, is fixed axially, and is turned in order to actuate the process valve. A disadvantage in the case of said arrangement is the complexity in terms of the system. A large amount of installation space is required here. Moreover, the limited service life is a problem. Furthermore, the manual actuation gets in the way of a frequent adjustment of a process valve during operation. Moreover, the mechanical arrangement is sensitive to jolts and vibrations which can be produced by way of the underwater vehicle.

SUMMARY

Proceeding herefrom, it is an object of the present disclosure to provide a hydraulic system and an apparatus which mitigate or even avoid the stated disadvantages. In particular, a compact overall design, namely a small installation space, and an increased service life are to be realized in a structurally simple way. Moreover, a frequent adjustment of the actuating drive is to be enabled in a simple way. Furthermore, a reliable actuation by way of, for example, an external robot in the case of an emergency is to be realized.

Said objects are achieved by way of a hydraulic system and by way of an apparatus as described herein. It is to be noted that the description, in particular in conjunction with the figures, cites further details and developments of the disclosure which can be combined with the other features described below.

A hydraulic system for use under water with a hydraulic actuating drive contributes to this, there being a hydraulic cylinder and at least one hydraulic machine. At least one rotary drive device and the hydraulic machine are coupled mechanically for a common rotating movement. Furthermore, the hydraulic machine adjusts at least the hydraulic cylinder. The hydraulic cylinder has at least three cylinder chambers. In addition, there are a first hydraulic circuit and a second hydraulic circuit which open into different cylinder chambers.

The hydraulic system which is proposed herein with the hydraulic actuating drive has the advantage that a smaller amount of installation space is combined with an increased service life in a structurally simple way. In particular, a frequent adjustment by way of an underwater vehicle, for example a robot, is enabled. Finally, undesired jolts and vibrations on the hydraulic cylinder are avoided, which jolts and vibrations can occur by way of the underwater vehicle. Two hydraulic circuits are advantageously combined with a plurality of cylinder chambers of a hydraulic cylinder. By virtue of the fact that the hydraulic cylinder has at least three cylinder chambers, two independent hydraulic circuits are assigned to the one hydraulic cylinder in a structurally elegant way, with the result that different functions of the two circuits can be realized by way of the same hydraulic cylinder.

The first hydraulic circuit preferably comprises the hydraulic cylinder and a first hydraulic machine, and the independent second hydraulic circuit preferably comprises the hydraulic cylinder and a second hydraulic machine, the hydraulic cylinder and the at least one hydraulic machine in each case being part of a hydrostatic transmission. The hydrostatic transmission operates in accordance with the positive displacement principle. Here, there are as a rule a driven hydraulic pump and the hydraulic cylinder.

The first hydraulic circuit with at least one cylinder chamber in the hydraulic cylinder is preferably set up as a normal working actuating drive, and the second hydraulic circuit with two further cylinder chambers in the hydraulic cylinder is preferably set up as an emergency actuating drive. As a result, the rotary drive device can both be used for the mechanical emergency adjustment of the hydraulic cylinder and can serve for the continuous adjustment of the hydraulic cylinder in normal working operation.

It is preferred that one and the same piston of the hydraulic cylinder can be moved to and fro along its movement axis (separately or independently) by way of each hydraulic circuit. The embodiment is, in particular, such that, for the case where a (first) hydraulic circuit is not functioning (correctly), the other (second or further) hydraulic circuit can realize the movement.

The hydraulic cylinder expediently has at least four or five cylinder chambers. It can be provided in this case that a (first) hydraulic circuit interacts with (first) two cylinder chambers, and a (second) hydraulic circuit interacts with (second) two cylinder chambers, and a prestressing or restoring unit for the piston rod of the hydraulic cylinder is additionally arranged in the fifth cylinder chamber.

Two cylinder chambers are preferably decoupled from the working movement of the piston rod or the hydraulic cylinder. In this way, the wear of seals is reduced.

The hydraulic cylinder is advantageously a differential cylinder or a synchronous cylinder. In the case of the differential cylinder, the two pressurized active faces on the piston are of different size. This results, during retraction and extension, in different forces at an identical operating pressure and different speeds at a constant volumetric flow. Differential cylinders are inexpensive and have a high power density which results from the high forces which can be achieved and the great strokes in relation to the size of the cylinder.

The hydraulic cylinder is expediently configured with a longitudinally displaceable piston for adjusting a process valve. The hydraulic cylinder preferably comprises a compression spring, for example a compression coil spring, for restoring the hydraulic cylinder. In an advantageous way, the compression spring is supported by way of its one end on the cylinder head and by way of its other end on the first piston or on a displaceable piston element.

In one preferred embodiment, the hydraulic cylinder is configured as a tandem cylinder. Here, the hydraulic cylinder is designed in such a way that two cylinders are connected to one another in such a way that the piston rod of the one cylinder acts through the base of the second cylinder on its piston face.

There is preferably a container, in the interior of which the hydraulic cylinder and the at least one hydraulic machine are arranged. The container is set up, in particular, in such a way that it is leakproof and durable against seawater even at a great depth.

The rotary drive device is advantageously arranged outside the container and is set up for coupling to the hydraulic machine and decoupling from the hydraulic machine.

Two rotary drive devices are expediently arranged outside the container, the second rotary drive device being provided for the normal actuation of the hydraulic cylinder, and the first rotary drive device being provided for the emergency actuation (bridging) of the hydraulic cylinder.

A remote-controlled underwater vehicle advantageously comprises the rotary drive device. The rotary drive device is preferably a torque tool of an underwater robot. The rotary drive device expediently comprises an electric motor. The electric motor can be provided outside the container (in the seawater region). It is possible for a separate electric motor to be provided within the container as working drive. There is preferably a coupling device between the rotary drive device and the hydraulic machine.

By way of the hydraulic system which is proposed herein, the mechanically driven, hydraulic emergency actuating drive is integrated in an advantageous way into a three-chamber or five-chamber cylinder. The three-chamber or five-chamber cylinder has at least one hydraulic safety unlocking function (three chambers) and possibly a hydrostatic drive (five chambers). In addition, two chambers are provided for the hydraulic emergency actuating drive which can be actuated mechanically from outside.

In the case of relatively large variants, a compact solution is required for a manual override (actuation of the cylinder by way of a robot via an external mechanical interface). A complete independent hydraulic circuit is realized by way of the hydraulic system which is proposed herein. The detailing of the hydraulic cylinder with separate chambers is particularly advantageously suitable for this purpose.

In accordance with a further aspect, an apparatus for arranging under water and for controlling a volumetric flow which can be conveyed of a gaseous or liquid medium is proposed, which apparatus is configured with a process valve. The process valve has a process valve housing and a process valve slide, by way of which the volume can be controlled. Furthermore, a hydraulic cylinder is provided which is assigned to the process valve housing and can be moved with the process valve slide. In addition, the apparatus has a hydraulic system with a hydraulic actuating drive, a rotary drive device being arranged on a remote-controlled underwater vehicle, which rotary drive device drives a hydraulic pump which adjust the hydraulic cylinder. The hydraulic cylinder has at least three cylinder chambers, there being a first hydraulic circuit and a second hydraulic circuit which open into different cylinder chambers. With regard to the description of the construction and/or the function of the hydraulic system, reference can be made to the further description.

BRIEF DESCRIPTION OF THE DRAWINGS

The disclosure and the technical environment will be described in greater detail in the following text on the basis of figures. Here, identical components are labeled by way of identical designations. The illustrations are diagrammatic and are not provided in order to illustrate size ratios. The explanations which are stated in respect of individual details of a figure can be extracted and can be combined freely with facts from other figures or from the preceding description, unless something different necessarily results for a person skilled in the art and/or a combination of this type is explicitly prohibited here. In the figures, in a diagrammatic manner.

DETAILED DESCRIPTION

Figure 1:
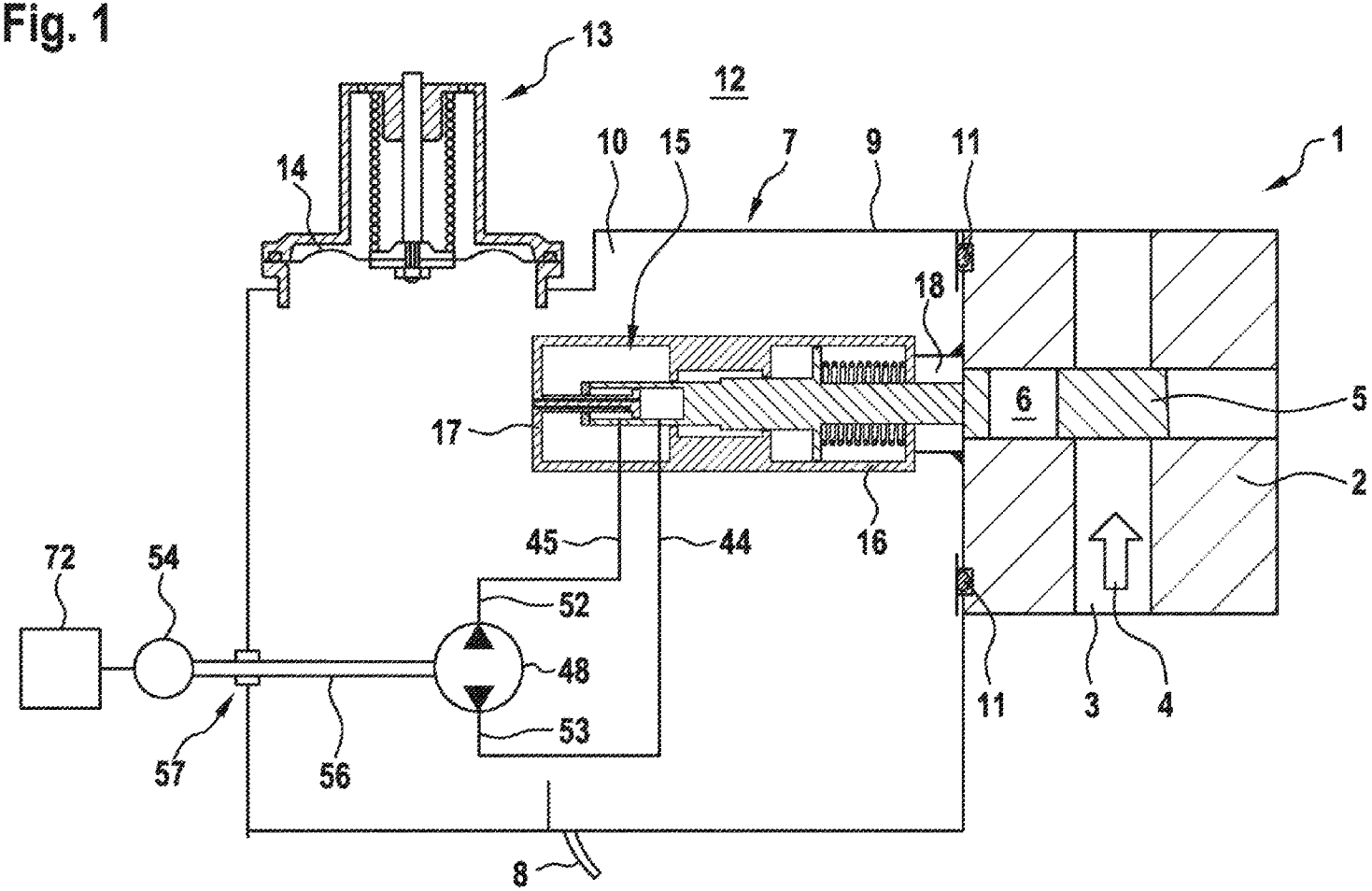
FIG. 1 shows a side view of the apparatus in the case of a closed process valve with a hydraulic cylinder with three cylinder chambers, one cylinder chamber being assigned to a displaceable piston, and two cylinder chambers being assigned to a stationary piston.

The exemplary embodiments which are shown in the figures of a hydraulic system have, in accordance with FIG. 1, a process valve 1 with a process valve housing 2, through which a process valve channel 3 runs which is continued at its orifices by way of tubes (not shown) and in which a gaseous or liquid medium flows from the seabed to a part of a drilling rig which protrudes out of the sea, or to a drill ship. The direction of flow is to be indicated by way of the arrow 4.

A cavity is configured in the process valve housing 2, which cavity crosses the process valve channel 3 and in which cavity a process valve slide 5 with a throughflow opening 6 can be moved transversely with respect to the longitudinal direction of the process valve channel 3. In the state according to FIG. 1, the process valve channel 3 and the throughflow opening 6 in the process valve slide 5 do not overlap one another. The process valve 1 is therefore closed. In a state which is not shown, the throughflow opening 6 and the process valve channel 3 overlap one another largely. The process valve 1 is almost completely open. A process valve of the indicated type and of the described use is firstly to be capable of being actuated in a controlled manner and secondly is also to contribute to the safety, by assuming a position rapidly and reliably in the case of a disruption, which position corresponds to a safe state. In the present case, said safe state is a closed process valve.

The process valve 1 is actuated by way of a compact hydraulic system 7 which is arranged under water directly on the process valve 1. It is sufficient that only one electric cable 8 leads from the hydraulic system 7, for example, to the sea surface or another superordinate electric controller which is situated under water.

The hydraulic system 7 which is shown as an exemplary embodiment has a container 9 which is fastened on an open side to the process valve housing 2, with the result that there is an interior 10 which is closed off with respect to the surroundings and is filled with a hydraulic pressure fluid as working medium. For fastening to the process valve housing 2, the container 9 has an inner flange on its open side, by way of which inner flange it is screwed to the process valve housing 2. A peripheral seal 11 is arranged radially outside the screw connections between the inner flange of the container 9 and the process valve housing 2, which seal 11 is inserted into a peripheral groove of the process valve housing 2.

The container 9 is pressure-compensated with respect to the ambient pressure which prevails under water (seawater region 12). To this end, a diaphragm 14 is clamped in tightly in an opening in the container wall in the case of a pressure compensator 13. Holes are situated in the cover, with the result that the space between the diaphragm 14 and the cover is part of the surroundings and is filled with seawater. The interior 10 is therefore shielded against the surroundings by way of the diaphragm 14. On its first face which faces the interior 10, the diaphragm 14 is loaded by the pressure in the interior 10 and, on its second face which faces the cover and is approximately equally as large as the first face, is loaded by the pressure which prevails in the surroundings, and always attempts to assume a position and shape, in which the sum of all the forces which act on it is zero.

Figure 2:
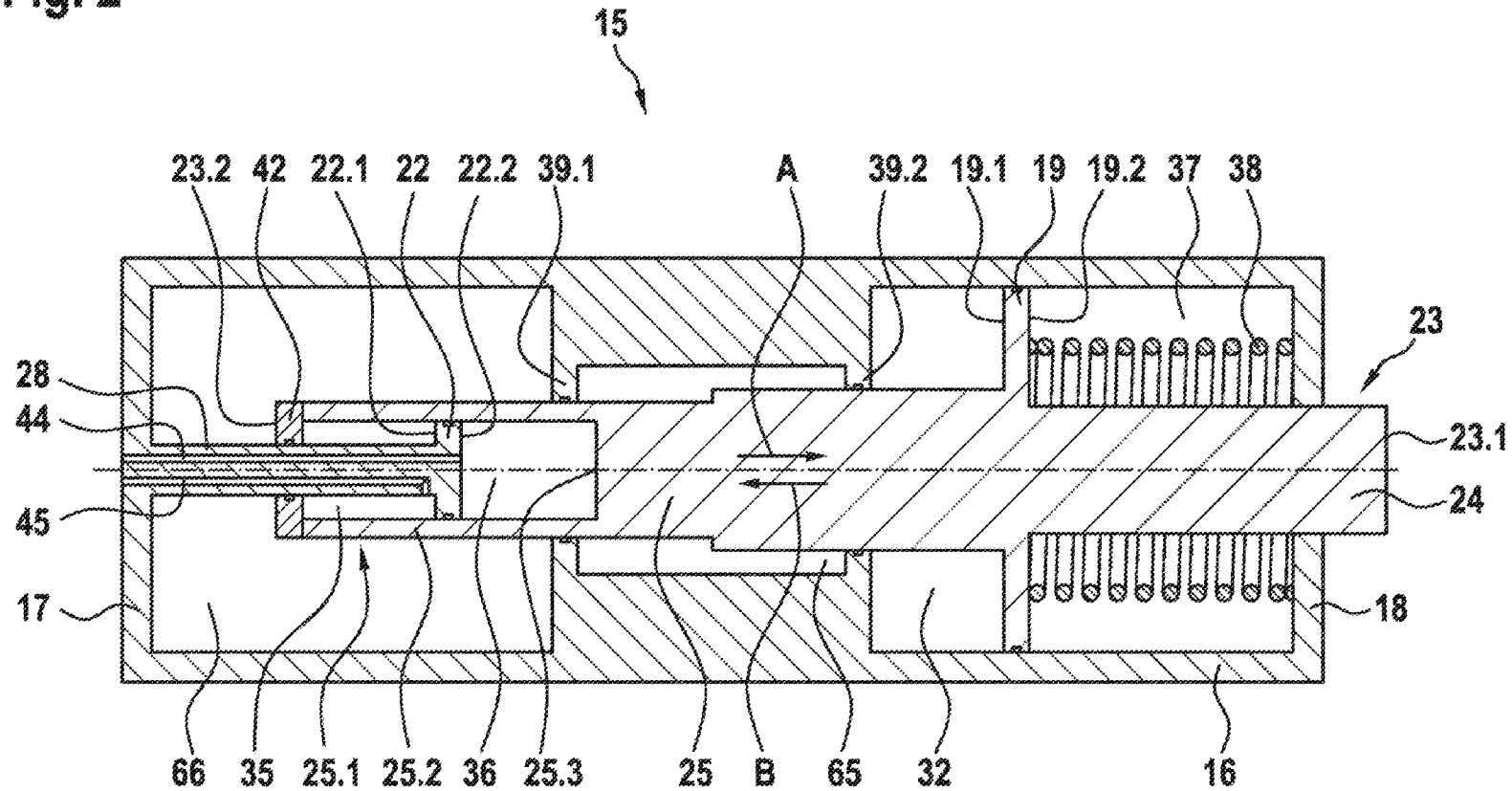
FIG. 2 shows the hydraulic cylinder according to FIG. 1 in detail on an enlarged scale.

There is a hydraulic cylinder 15 with a cylinder housing 16 in the interior 10 of the container 9, which cylinder housing 16 is closed on the end side by way of a cylinder base 17 and a cylinder head 18, with a piston 19 which can be displaced in the interior of the cylinder housing 16 in the longitudinal direction of the cylinder housing (as shown in FIG. 2) and with a first displaceable piston rod 24 which is connected fixedly to the piston 19, protrudes on one side away from the piston 19, and passes through the cylinder head 18 in a manner which is sealed and guided in a way which is not shown in greater detail. The gap between the piston rod 24 and the cylinder head is sealed by way of two seals (not shown) which are arranged at an axial spacing from one another in the cylinder head 18. The process valve slide 5 is fastened to the free end of the piston rod 24. Furthermore, there is a second displaceable piston rod 25 which is connected fixedly to the piston 19, protrudes away from the piston 19 toward the other side, is guided in a sealed manner and passes through a first cylinder inner wall 39.1 and through a second cylinder inner wall 39.2. The interior of the cylinder housing 16 is divided by way of the piston 19 into a cylinder base-side first cylinder chamber 32 and into a cylinder head-side spring chamber 37, the volumes of which are dependent on the position of the piston 19. 19.1 denotes a first end face of the piston 19, and 19.2 denotes a second end face of the piston 19. 23.1 denotes a first end face of the piston rod 23, and 23.2 denotes a second end face of the piston rod 23.

A compression spring 38 is accommodated in the spring chamber 37, which compression spring 38 surrounds the piston rod 24 coaxially and is clamped in between the cylinder head 18 and the piston 19, that is to say loads the piston 19 in a direction, in which the piston rod 24 is retracted and the process valve slide 5 is moved in order to close the process valve 1.

According to FIG. 2, that end region 25.1 of the second displaceable piston rod 25 which faces the cylinder base is configured (in part) as a hollow cylinder with a hollow cylinder wall 25.2 and a hollow cylinder base 25.3, opposite which a closing first cover element 42 with a circularly annular cross section lies. A stationary piston 22 (which is connected to the cylinder housing 16) is situated in the inner cavity of the hollow cylinder, from the first end face 22.1 of which piston 22 a stationary piston rod 28 extends, starting from and penetrating the opening of the cover element 42, as far as the cylinder base 17. 65 denotes a first cylinder inner cavity, and 66 denotes a second cylinder inner cavity.

The hydraulic cylinder 15 has three cylinder chambers, namely a first cylinder chamber 32, a fourth cylinder chamber 35 and a fifth cylinder chamber 36. The two cylinder chambers 35 and 36 are part of a hydraulic bridging arrangement for an emergency, whereas the cylinder chamber 32 serves for the normal working operation of the hydraulic cylinder 15. In this way, an emergency actuating drive is integrated into a three-chamber cylinder. The two cylinder chambers 35 and 36 in addition to the cylinder chamber 32 are provided for the hydraulic emergency actuating drive which can be actuated mechanically from the outside. 44 and 45 denote channels in the stationary piston rod 28, which channels convey hydraulic fluid into and out of the cylinder chambers 35 and 36. A and B denote direction arrows for the movement directions of the piston rod 23. The movement directions A and B apply in the same way to the displaceable piston 19 which is connected fixedly to the piston rod 23, and the end region 25.1 which is connected fixedly to the piston rod 23.

A hydraulic machine 48 which can be operated as a pump with two conveying directions is also situated in the interior 10 of the container 9. The hydraulic machine 48 has a first pressure and suction connector 52 and a second pressure and suction connector 53. Pressure fluid which is sucked in during operation as a pump can be conveyed by the hydraulic machine 48 via the pressure connector 52 to the cylinder chambers. Conversely, pressure fluid can be extracted from the cylinder chambers via the hydraulic machine 48 (in this regard, see FIG. 9).

A rotary drive device 54 is coupled mechanically to the hydraulic machine 48 for a common rotating movement, for example via a shaft 56. The shaft 56 transmits the torque from the rotary drive device 28 to the hydraulic machine 48. The rotary drive device 54 is situated outside the container 9. It is encompassed, for example, by a remote-controlled underwater vehicle 72 (ROV) or a robot, and preferably has an electric motor as rotary drive device 54.

In order that the process valve 1 can be actuated by way of a robot, such as, for example, by way of an ROV, there is an interface 57 on the container 9, starting from which interface 57 the shaft 56 is coupled to the hydraulic machine 48 in the interior 10.

Figure 9:
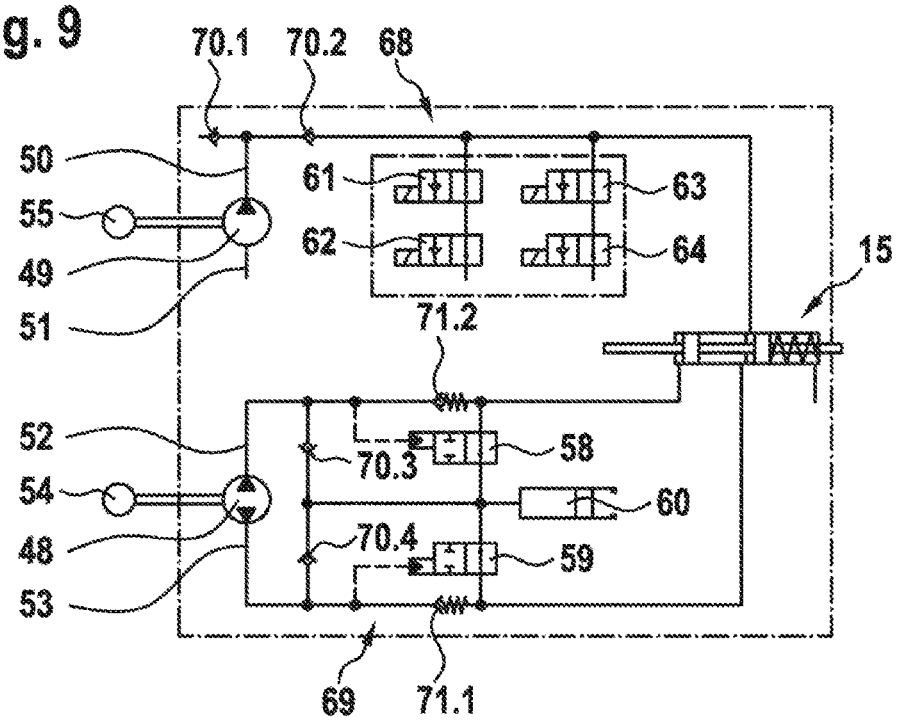
FIG. 9 shows a circuit diagram of a hydraulic system with a hydraulic cylinder which is configured as a tandem cylinder with three cylinder chambers and two hydraulic circuits.

FIG. 1 shows, in a simplified manner, the second independent hydraulic circuit 69, which is shown in detail in FIG. 9, as an emergency actuating drive. In the case of the embodiment according to FIG. 1, the first hydraulic circuit 68 which is shown in FIG. 9 can be used as normal working actuating drive. As an alternative (in a way which is not shown), the working actuating drive can be realized by way of a combination of the hydraulic pump with an additional electric motor (not shown).

There are in each case five cylinder chambers in the embodiment according to FIGS. 3 to 8, that is to say a first cylinder chamber 32, a second cylinder chamber 33, a third cylinder chamber 34, a fourth cylinder chamber 35 and a fifth cylinder chamber 36. The two cylinder chambers 35 and 36 are part of a hydraulic bridging arrangement for an emergency, whereas the cylinder chambers 32, 33 and 34 are provided for the normal working operation of the hydraulic cylinder 15. All variants of the five cylinder chambers can be used for hydraulic cylinder 15 with three cylinder chambers (see FIGS. 2 and 9). In all the exemplary embodiments according to FIGS. 1 to 9, there are in each case a first cylinder chamber 32, a fourth cylinder chamber 35 and a fifth cylinder chamber 36. In the exemplary embodiments according to FIGS. 3 to 8, there are in each case additionally a second cylinder chamber 33 and a third cylinder chamber 34 which serve for the normal working operation of the hydraulic cylinder 15.

Figure 3:
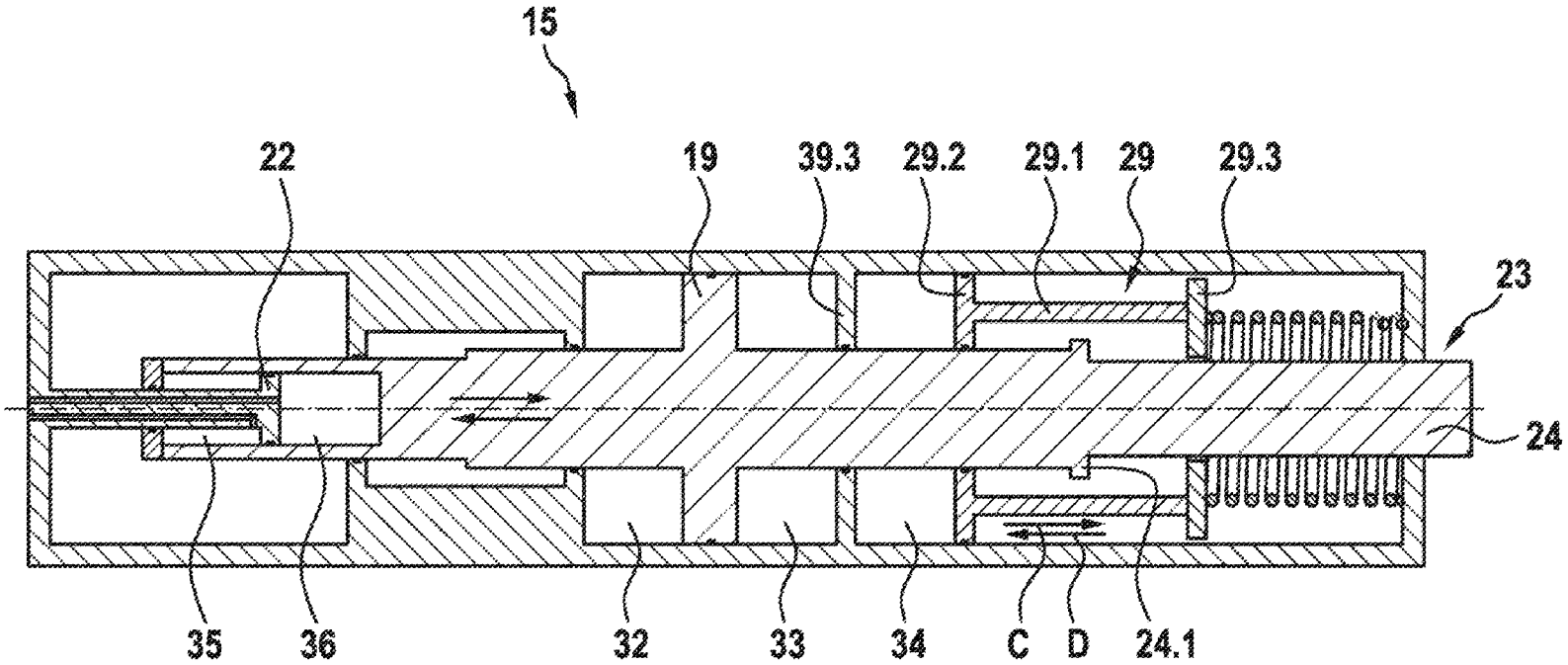
FIG. 3 shows one embodiment of the hydraulic cylinder with five cylinder chambers, two cylinder chambers being assigned to a first displaceable piston, one cylinder chamber being assigned to a displaceable piston element, and two cylinder chambers being assigned to a stationary piston.

FIG. 3 shows an embodiment of the hydraulic cylinder 15 with five cylinder chambers 32, 33, 34, 35, 36, two cylinder chambers 32, 33 being assigned to a first displaceable piston 19, one cylinder chamber 34 being assigned to a displaceable piston element 29, and two cylinder chambers 35, 36 being assigned to the stationary piston 22. The cylinder chamber 34 is delimited by way of a first hollow piston 29.2 and a third cylinder inner wall 39.3. The displaceable piston element 29 consists of a hollow-cylindrical composite element 29.1, to the two end regions of which in each case a first hollow piston 29.2 and a second hollow piston 29.3 are attached, the openings of which are penetrated coaxially by the first displaceable piston rod 24. The piston element 29 can be displaced in a sealed manner on the piston rod 24 in the direction of the arrows C and D. 24.1 denotes a collar-shaped attachment on the piston rod 24 which, in the case of movement of the piston rod 24 in the directions A and B, is capable of moving the piston element 29 in the directions C and D by way of engagement with the hollow piston 29.1 and 29.2.

Figure 4:
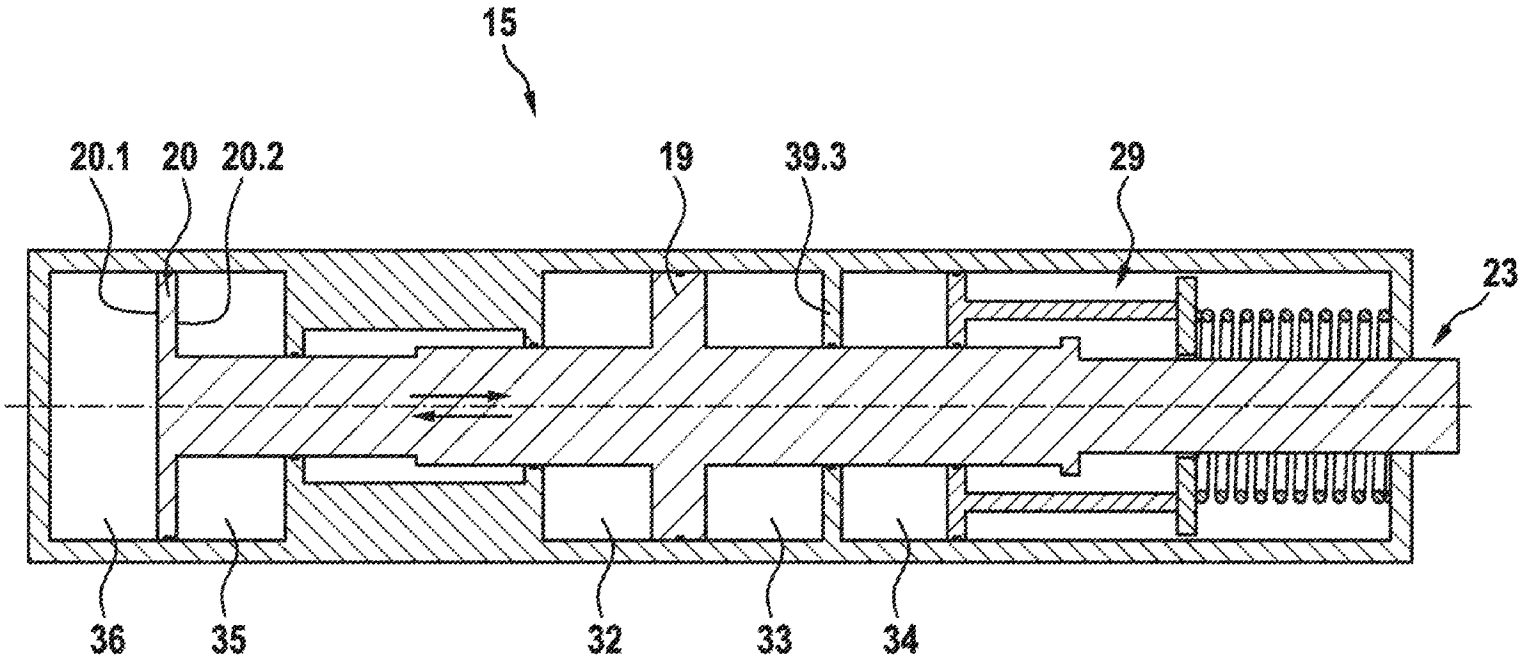
FIG. 4 shows an embodiment as in FIG. 3, but two cylinder chambers are assigned to a second displaceable piston.

FIG. 4 illustrates an embodiment, in the case of which two cylinder chambers 35, 36 are assigned to a second displaceable piston 20. In this way, a differential cylinder is formed, in the case of which the two pressurized active faces on the piston 20, that is to say the first end face 20.1 and the second end face 20.2, are of different size.

Figure 5:
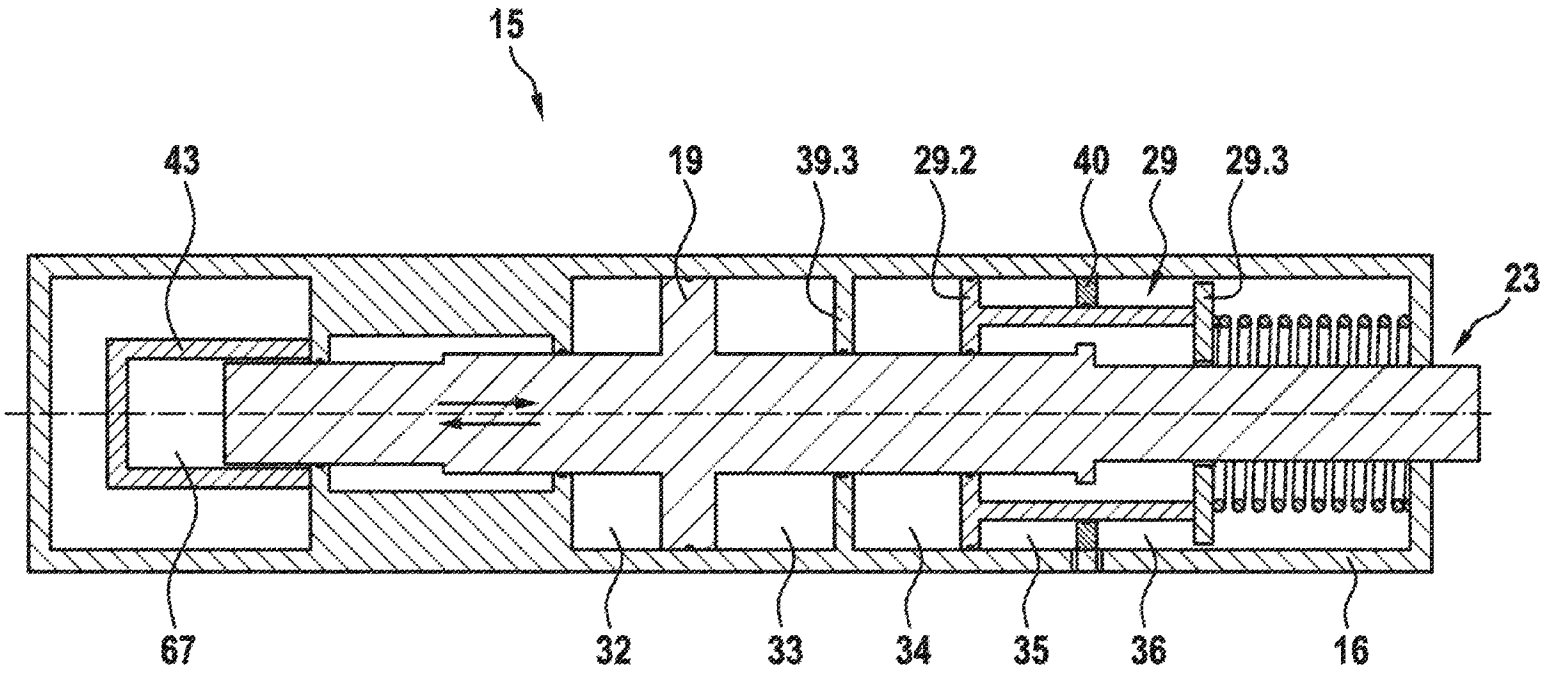
FIG. 5 shows an embodiment as in FIG. 3, but two cylinder chambers are assigned to a displaceable piston element.

FIG. 5 illustrates an embodiment, two cylinder chambers 35, 36 being assigned to the displaceable piston element 29. In order to form the cylinder chambers 35, 36, a cylinder inner chamber dividing wall 40 is provided which is present between the housing wall of the cylinder housing 16 and the composite element 29.1 and the hollow pistons 29.2 and 29.3. A third cylinder inner cavity 67 is formed at the base-side end of the piston rod 23, which third cylinder inner cavity 67 is enclosed by a cup-shaped second cover element 43.

Figure 6:
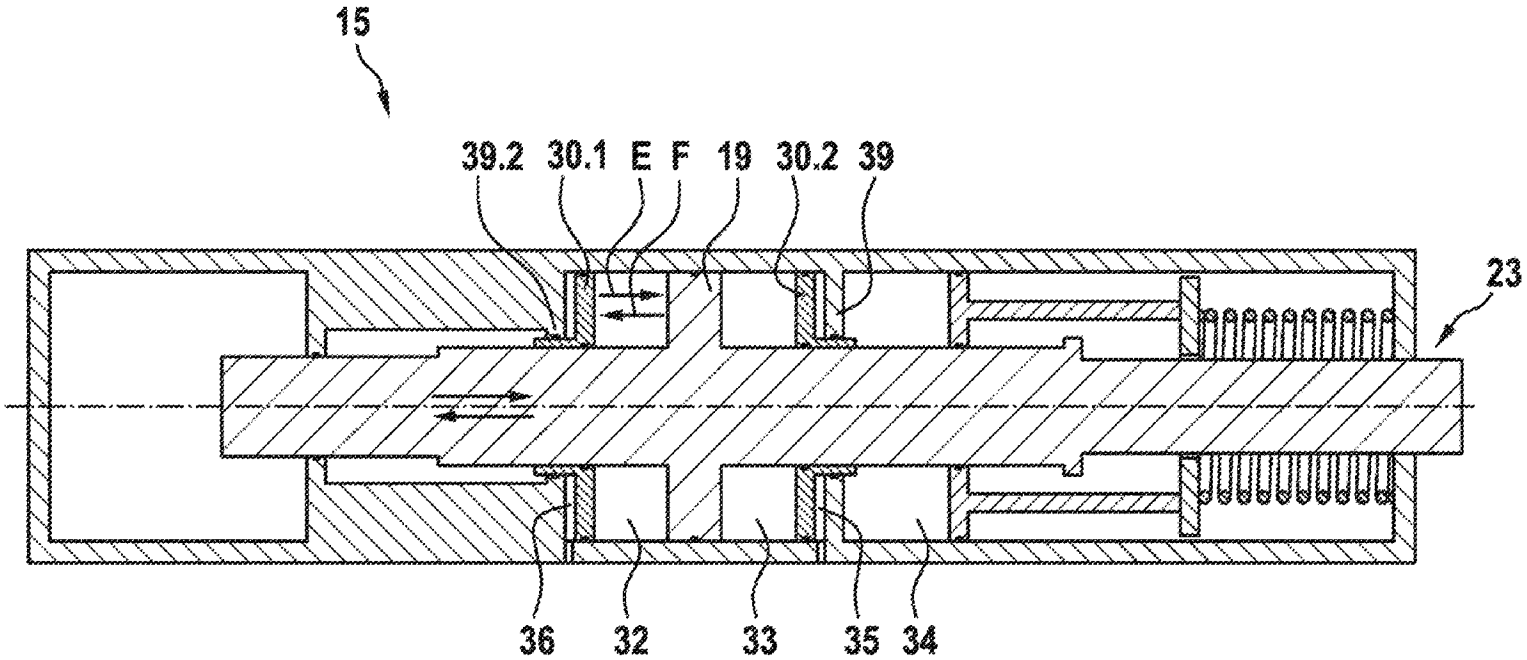
FIG. 6 shows an embodiment as in FIG. 3, but two cylinder chambers are assigned in each case to a displaceable grommet.

FIG. 6 represents an embodiment, two cylinder chambers 35 and 36 being assigned in each case to a grommet 30.1 and 30.2, respectively, which can be displaced in the direction of the arrows E, F. The grommets 30.1 and 30.2 are arranged coaxially and in a sealed manner with respect to the first piston rod 24 and with respect to the second piston rod 25, respectively. The cylinder chambers 35 and 36 are formed between the grommets 30.1 and 30.2 and the opposite cylinder inner walls 39 and 39.2, respectively.

Figure 7:
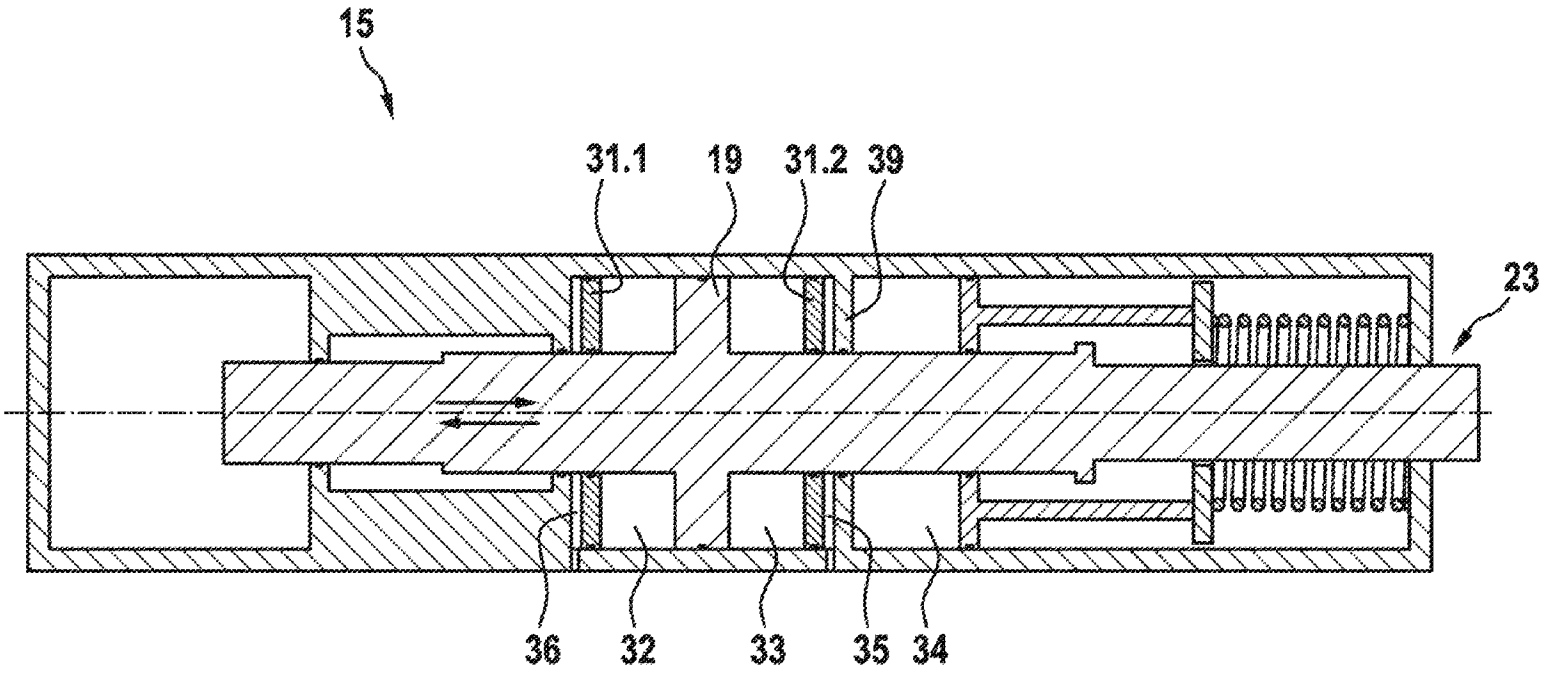
FIG. 7 shows an embodiment as in FIG. 3, but two cylinder chambers are assigned in each case to a displaceable sealing washer.

FIG. 7 shows an embodiment which is similar to FIG. 6, in the case of which, instead of the grommets 30.1 and 30.2, there are, however, two hollow-cylindrical sealing washers 31.1 and 31.2 which can be displaced in the direction of the arrows G and H.

Figure 8:
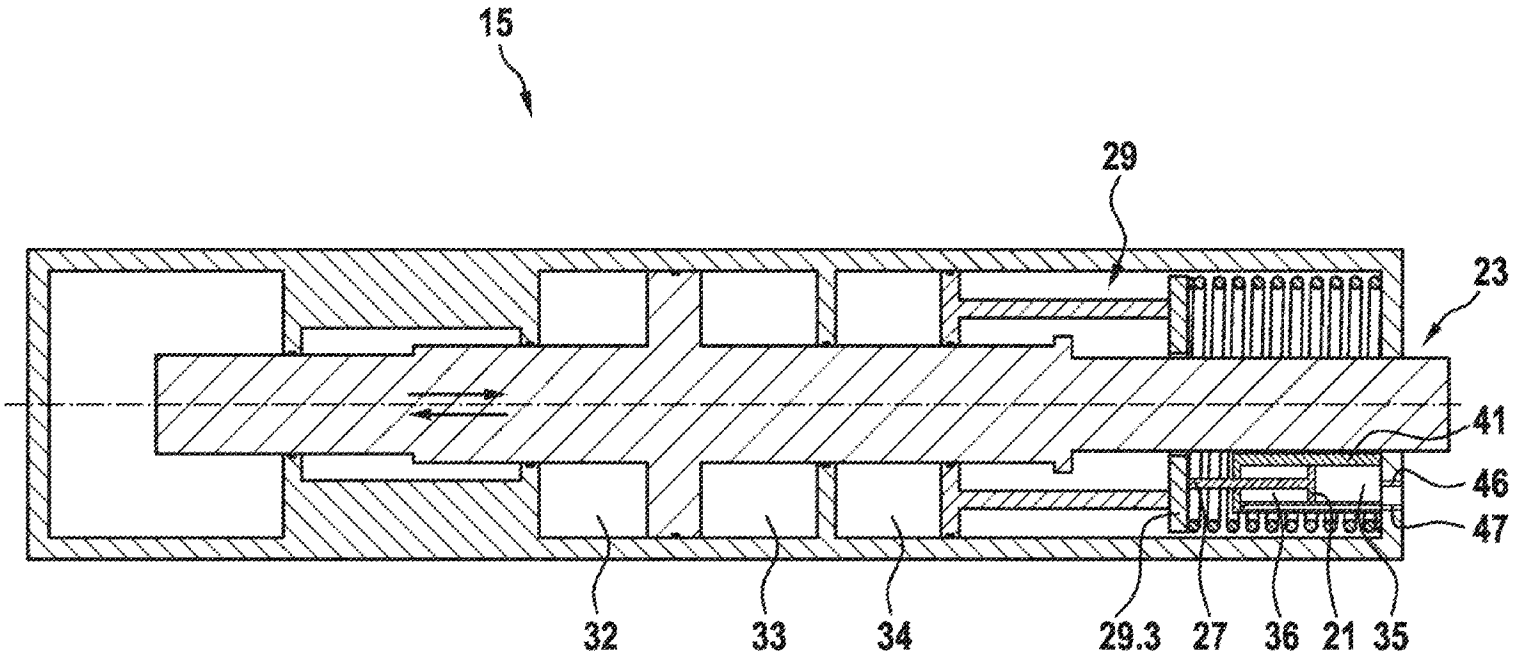
FIG. 8 shows an embodiment as in FIG. 3, but two cylinder chambers are assigned to a third displaceable piston.

FIG. 8 illustrates an embodiment, in the case of which two cylinder chambers 35 and 36 are assigned to a third displaceable piston 21. On one side, a fourth displaceable piston rod 27 emanates from the piston 21, which fourth displaceable piston rod 27 is connected to the second hollow piston 29.3. A cylinder tube 41 is arranged in the spring chamber 37, in the inner cavity of which cylinder tube 41 the piston 21 can be displaced together with the piston element 29 in the direction of the arrows C and D. 46 and 47 denote channels for the throughflow of hydraulic fluid into the cylinder chambers 35 and 36, respectively.

FIG. 9 illustrates a circuit diagram of a hydraulic system with the hydraulic cylinder 15 which is configured as a tandem cylinder, and three cylinder chambers 32, 35 and 36 (see FIG. 10) and two hydraulic circuits 68 and 69. The circuit 68 is an open circuit with the second hydraulic machine 49 which is configured as a pump with a constant displacement volume of one conveying direction and one rotational direction. The pump has a pressure connector 50 and a suction connector 51. 61 to 64 denote directional seat valves, and 70.1 and 70.2 denote check valves without pressure drop. The circuit 69 is a closed circuit with the first hydraulic machine 48 which is configured as a pump with two conveying directions. The pump has a first pressure and suction connector 52 and a second pressure and suction connector 53. 58 and 59 denote hydraulic shut-off valves, and 60 denotes a hydraulic accumulator, for example a piston accumulator. 70.3 and 70.4 denote check valves without pressure drop, and 71.1 and 71.2 denote check valves with pressure drop. 26 denotes a third displaceable piston rod.

In the case of the first (open) circuit 68, the volumetric flow flows from the outflow side of the hydraulic cylinder 15 to a container (not shown). In the case of the second (closed) circuit 69, the volumetric flow is fed from the outflow side of the hydraulic cylinder 15 directly again to the suction line of the pump; the volumetric flow which flows back is identical to the volumetric flow which flows in. The two circuits 68 and 69 in each case form a hydrostatic transmission, comprising the hydraulic cylinder and the hydraulic machines 48 and 49 which are configured as a pump.

Two rotary drive devices 54, 55 are arranged outside the container 9, the second rotary drive device 55 being set up as a normal working actuating drive for the hydraulic cylinder 15, and the first rotary drive device 54 being set up as an emergency actuating drive for the hydraulic cylinder 15.

Figure 10:
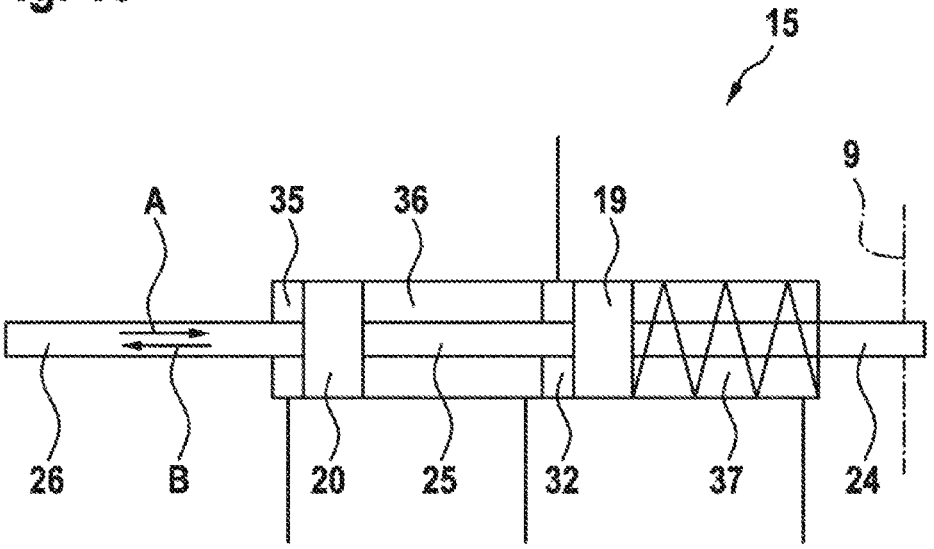
FIG. 10 shows the hydraulic cylinder according to FIG. 9 in detail on an enlarged scale.

In the case of the design variants which are shown in FIGS. 3 to 8, there are five cylinder chambers 32, 33, 34, 35, 36 and a spring chamber 37 with a compression spring 38. In the embodiment which is shown in FIG. 10, three cylinder chambers 32, 35, 36 and a spring chamber with a compression spring 38 are provided. In accordance with one embodiment (not shown), the configuration according to FIG. 10 can be modified in such a way that there are four cylinder chambers, that is to say that the spring chamber 37 is set up without a compression spring 38 as a further (fourth) cylinder chamber.

LIST OF DESIGNATIONS

1 Process valve
2 Process valve housing
3 Process valve channel
4 Arrow
5 Process valve slide
6 Throughflow opening
7 Hydraulic system
8 Cable
9 Container
10 Interior of 9
11 Seal
12 Seawater region
13 Pressure compensator
14 Diaphragm
15 Hydraulic cylinder
16 Cylinder housing
17 Cylinder base
18 Cylinder head
19 First displaceable piston
19.1 First end face of 19
19.2 Second end face of 19
20 Second displaceable piston
20.1 First end face of 20
20.2 Second end face of 20
21 Third displaceable piston
22 Stationary piston
22.1 First end face of 22
22.2 Second end face of 22
23 Piston rod
23.1 First end face of 23
23.2 Second end face of 23
24 First displaceable piston rod
24.1 Attachment on 24
25 Second displaceable piston rod
25.1 End region of 25
25.2 Hollow cylinder wall
25.3 Hollow cylinder base
26 Third displaceable piston rod
27 Fourth displaceable piston rod
28 Stationary piston rod
29 Displaceable piston element
29.1 Composite element
29.2 First hollow piston
29.3 Second hollow piston
30.1 First displaceable grommet
30.2 Second displaceable grommet
31.1 First displaceable sealing washer
31.2 Second displaceable sealing washer
32 First cylinder chamber
33 Second cylinder chamber
34 Third cylinder chamber
35 Fourth cylinder chamber
36 Fifth cylinder chamber
37 Spring chamber
38 Compression spring
39 Cylinder inner wall
39.1 First cylinder inner wall
39.2 Second cylinder inner wall
39.3 Third cylinder inner wall
40 Cylinder inner chamber dividing wall
41 Cylinder tube
42 First cover element
43 Second cover element
44 First channel
45 Second channel
46 Third channel
47 Fourth channel
48 First hydraulic machine
49 Second hydraulic machine
50 Pressure connector
51 Suction connector
52 First pressure or suction connector
53 Second pressure or suction connector
54 First rotary drive device
55 Second rotary drive device
56 Shaft
57 Interface
58 First hydraulically closable valve
59 Second hydraulically closable valve
60 Hydraulic accumulator
61 First directional seat valve
62 Second directional seat valve
63 Third directional seat valve
64 Fourth directional seat valve
65 First cylinder inner cavity
66 Second cylinder inner cavity
67 Third cylinder inner cavity
68 First circuit
69 Second circuit
70.1 First check valve without pressure drop
70.2 Second check valve without pressure drop
70.3 Third check valve without pressure drop
70.4 Fourth check valve without pressure drop
71.1 First check valve with pressure drop
71.2 Second check valve with pressure drop
72 Remote-controlled underwater vehicle

The invention claimed is:

1. A hydraulic system for use under water, comprising:
a hydraulic cylinder having at least three cylinder chambers;

at least one hydraulic machine configured to adjust the hydraulic cylinder;

a first hydraulic circuit that includes at least one first cylinder chamber of the at least three cylinder chambers;

a second hydraulic circuit hydraulically separate from the first hydraulic circuit, the second hydraulic circuit including at least two second cylinder chambers of the at least three cylinder chambers;

a container defining an interior in which the hydraulic cylinder and the at least one hydraulic machine are arranged;

an interface having a portion that is external to the container, the interface being operably connected to the at least one hydraulic machine; and a remote-controlled underwater vehicle having a first rotary drive device configured to be selectively coupled to and decoupled from the at least one hydraulic machine via the external portion of the interface such that the first rotary drive device drives the at least one hydraulic machine when coupled to the at least one hydraulic machine.

2. The hydraulic system as claimed in claim 1, wherein:

the first hydraulic circuit includes a first hydraulic machine of the at least one hydraulic machine, and the second hydraulic circuit includes a second hydraulic machine of the at least one hydraulic machine.

3. The hydraulic system as claimed in claim 1, wherein:

the first hydraulic circuit is configured as a normal working actuating drive, and the second hydraulic circuit is configured as an emergency actuating drive.

4. The hydraulic system as claimed in claim 1, wherein the at least three cylinder chambers includes at least four cylinder chambers.

5. The hydraulic system as claimed in claim 1, wherein two cylinder chambers of the at least three cylinder chambers are decoupled from a working movement of a piston rod of the hydraulic cylinder.

6. The hydraulic system as claimed in claim 1, wherein the hydraulic cylinder is a differential cylinder or a synchronous cylinder.

7. The hydraulic system as claimed in claim 1, wherein the hydraulic cylinder includes a displaceable first piston configured to adjust a process valve.

8. The hydraulic system as claimed in claim 1, wherein the hydraulic cylinder comprises a compression spring configured for restoring the hydraulic cylinder.

9. The hydraulic system as claimed in claim 8, wherein the compression spring is supported at a first end on a cylinder head and a second end on a first piston of the hydraulic cylinder that is configured to adjust a process valve or on a piston element.

10. The hydraulic system as claimed in claim 1, wherein the hydraulic cylinder is configured as a tandem cylinder.

11. The hydraulic system as claimed in claim 1, further comprising:

a second rotary drive device arranged outside the container and configured for normal actuation of the hydraulic cylinder.

12. The hydraulic system as claimed in claim 1, wherein the container is leakproof and is filled with a hydraulic pressure fluid.

13. An apparatus configured to be arranged underwater and to control a volumetric flow conveyed of a gaseous or liquid medium, comprising:

a process valve that includes a process valve housing and a process valve slide by way of which the volumetric flow is controlled; and a hydraulic system comprising:

a hydraulic cylinder assigned to the process valve, the hydraulic cylinder having at least three cylinder chambers, the hydraulic cylinder being configured to move the process valve slide;

at least one hydraulic machine configured to adjust the hydraulic cylinder;

a first hydraulic circuit that includes at least one first cylinder chamber of the at least three cylinder chambers; and a second hydraulic circuit hydraulically separate from the first hydraulic circuit, the second hydraulic including at least two second cylinder chambers of the at least three cylinder chambers;

a container defining an interior in which the hydraulic cylinder and the at least one hydraulic machine are arranged;

an interface having a portion that is external to the container, the interface being operably connected to the at least one hydraulic machine; and a remote-controlled underwater vehicle having a first rotary drive device configured to be selectively coupled to and decoupled from the at least one hydraulic machine via the external portion of the interface such that the first rotary drive device drives the at least one hydraulic machine when coupled to the at least one hydraulic machine.

* * * * *